United States Patent [19]

Pfalser et al.

[11] Patent Number: 5,040,599

[45] Date of Patent: Aug. 20, 1991

[54] CATHODIC PROTECTION

[75] Inventors: Ivan L. Pfalser, Caney, Kans.; Michael S. Brannan, Bartlesville, Okla.

[73] Assignee: Phillips Petroleum Company, Bartlesville, Okla.

[21] Appl. No.: 445,250

[22] Filed: Dec. 4, 1989

[51] Int. Cl.[5] ..... E21B 41/02

[52] U.S. Cl. ..... 166/248; 166/902; 204/148; 204/196

[58] Field of Search ..... 166/248, 902; 405/154; 204/148, 147, 196, 197

[56] References Cited

U.S. PATENT DOCUMENTS

| | | | |
|---|---|---|---|
| 1,962,696 | 6/1934 | Rhodes | 204/196 X |
| 2,541,062 | 2/1951 | Hoxeng | 204/148 |
| 2,565,544 | 8/1951 | Brown | 204/148 |
| 4,400,259 | 8/1983 | Schutt | 204/147 X |
| 4,409,080 | 10/1983 | Slough | 204/147 X |
| 4,413,679 | 11/1983 | Perkins | 166/248 |
| 4,495,990 | 1/1985 | Titus et al. | 166/248 X |

*Primary Examiner*—William P. Neuder
*Attorney, Agent, or Firm*—William R. Sharp

[57] ABSTRACT

Cathodic corrosion protection of a metallic structure in contact with the earth employs a backfill material which is a mixture of a carbonaceous solid and a clay. The backfill mixture is used to fill around at least one anode which is positioned in a borehole in the earth. A DC voltage is applied to the metallic structure and anode to provide the corrosion protection. The backfill mixture is highly electrically conductive and is relatively impermeable to water so as to assist in preventing intermingling, and possible contamination, of different aquifers through which the borehole penetrates.

20 Claims, 2 Drawing Sheets

CATHODIC PROTECTION

BACKGROUND OF THE INVENTION

The present invention relates to cathodic protection of a metallic structure in contact with the earth from corrosion. More particularly, the invention relates to a method of cathodically protecting such a metallic structure and to a cathodic protection system for protecting such a metallic structure. According to another aspect, the invention relates to a method of preparing a cathodic protection system.

The technique of cathodically protecting a metallic structure which is in contact with the earth basically involves applying an electrical DC voltage across the metallic structure and a grounded electrically conductive member such that the metallic structure is the cathode and the grounded conductive member is the anode. A current is established between the anode and cathode through the earth. This flow of current causes a surplus of electrons at the cathodic metallic structure which combine with positively charged hydrogen ions from the environment to form hydrogen. Thus, a hydrogen film results over the cathodic metallic structure which tends to isolate it from the environment so as to assist in preventing corrosion.

In actual practice, the electrically conductive member which serves as the anode is grounded by positioning the conductive member within a borehole in the earth, and then filling the borehole around the conductive member with a particulate, electrically conductive "backfill" material, such as coke. The backfill material provides excellent electrical contact between the surrounding earth and the anodic conductive member.

Although cathodic protection as described above has been widely employed as an effective technique to prevent corrosion, further improvement would be desirable, particularly with regard to the backfill material.

SUMMARY OF THE INVENTION

It is, therefore, an object of the invention to provide an improved cathodic protection system and method which utilizes an improved backfill material.

The above object is realized by a cathodic protection system for protecting a metallic structure in contact with the earth from corrosion which comprises: at least one electrically conductive member positioned in a borehole in the earth which is defined by an earthen sidewall; a quantity of a particulate mixture of a clay and a carbonaceous solid which at least partially fills the borehole around the conductive member(s) such that the mixture contacts the earthen sidewall and the conductive member(s), wherein the mixture has a clay to carbonaceous solid weight ratio of at least about 0.1:1; means for applying a DC electrical voltage to the metallic structure and the conductive member(s) such that the metallic structure is at a negative polarity and the conductive member(s) is at a positive polarity.

According to another aspect of the invention, a method of preparing such a cathodic protection system is provided wherein the conductive member(s) is positioned in the borehole, after which at least a portion of the borehole is filled with the particulate mixture of clay and carbonaceous solid around the conductive member(s). A DC electrical voltage source is provided having a positive terminal connected to the conductive member(s) and a negative terminal connected to the metallic structure.

According to yet another aspect of the invention, a method of cathodically protecting the metallic structure is provided wherein the borehole is at least partially filled around the conductive member(s) with the mixture of clay and carbonaceous solid having a clay to carbonaceous solid weight ratio of at least about 0.1:1; and a DC electrical voltage is applied to the metallic structure and the conductive member so as to make the metallic structure the cathode and the conductive member the anode. A current is thereby established between the metallic structure and the conductive member(s) through the earth and the particulate mixture which assists in preventing corrosion of the metallic structure in a manner discussed above.

In accordance with the invention, utilization of the particulate mixture of clay and carbonaceous solid as a backfill material in the borehole is advantageous since the particulate mixture is substantially impermeable to water. Therefore, in a situation where the borehole penetrates through two or more aquifers (i.e. water bearing strata), the particulate mixture effectively prevents flow of water from the different aquifers therethrough. Therefore, intermingling of water from the different aquifers is prevented so as to also prevent contamination of an aquifer with water from another aquifer. This is a distinct improvement over conventional cathodic protection systems which utilize only a carbonaceous material such as coke which is highly permeable to water so as to permit intermingling of aquifers. By way of example, it is particularly important that a fresh water aquifer, which is available for agricultural, industrial, and domestic use, not be contaminated by salt water aquifers.

Furthermore, the mixture of clay and carbonaceous solid in accordance with the invention is advantageous insofar as test data indicates such a mixture to be more conductive that a backfill material of only a carbonaceous solid, such as coke, for example.

DETAILED DESCRIPTION OF THE INVENTION

An embodiment of the invention will now be described with reference to the drawings.

Figure 1:
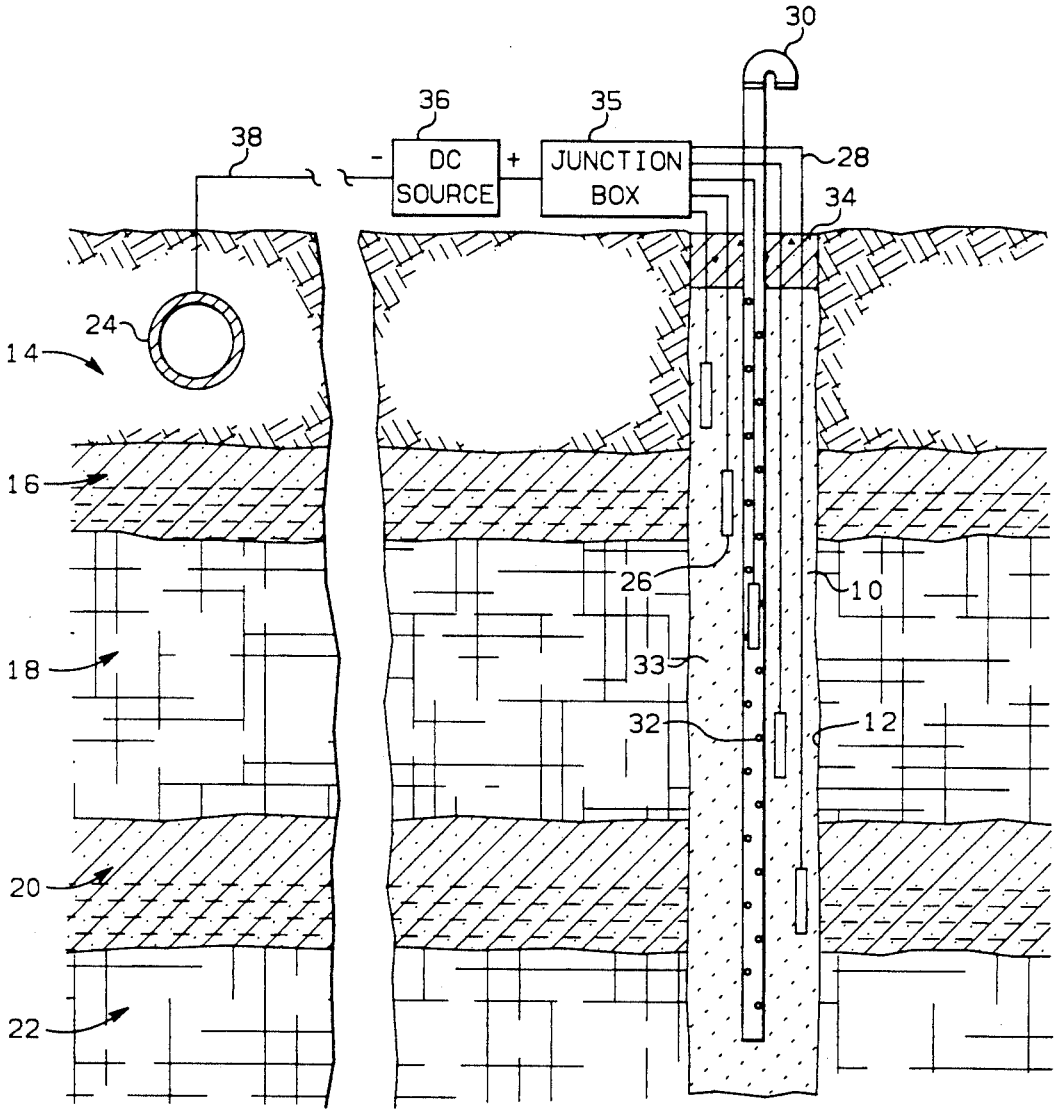
FIG. 1 is a schematic illustration of one embodiment of a cathodic protection system in accordance with the invention.

Referring to FIG. 1, which is not necessarily drawn to scale, there is shown a borehole 10 as defined by a earthen sidewall 12. Borehole 10 is typically about 8 to about 12 inches in diameter and can be up to several hundred feet in depth. The depth of borehole 10 is related to the distance from which a metallic structure can be protected insofar as an increase in depth is associated with the capability to protect more distant metallic structures. As shown, borehole 10 extends through several strata of the earth which in the illustrated embodiment includes an upper stratum 14, a water bearing stratum or aquifer 16, a stratum of rock 18, a second aquifer 20, and a second rock stratum 22. Water in aquifers 16 and 20 is indicated in FIG. 1 by dashed lines.

The metallic structure being protected in the illustrated embodiment is an underground pipe 24 which is shown as being within upper stratum 14.

The illustrated cathodic protection system includes a plurality of electrically conductive members 26, hereinafter denoted as anodes, which are longitudinally spaced along borehole 10 and which are connected to respective cable leads 28 which extend above the top of borehole 10. Each anode 26 is composed of an electrically conductive material such as magnesium, steel, platinum, silicon iron, or graphite. Each cable lead 28 is also electrically conductive and is preferably coated with a polyolefin such as Halar ® or Kynar ®. It is also within the scope of the invention to use only a single anode which extends along borehole 10, but such a structure would be impractical and expensive in view of the typical depth of borehole 10.

A vent pipe 30 is provided which extends through borehole 10 so as to be closely adjacent to anodes 26. Vent pipe 30 has a plurality of holes 32 in the sidewall thereof which are adapted to receive gases produced by electrochemical reactions along anodes 26. Such gases flow upwardly through vent pipe 30 and into the atmosphere. Although not shown, a gas permeable, nonwoven fabric could be wrapped around the exterior surface of vent pipe 30 to assist in preventing clogging of holes 32 with backfill material.

The backfill material utilized in accordance with the present invention and as indicated at 33 is a particulate mixture, hereinafter denoted as backfill mixture, of a clay and carbonaceous solid which in the illustrated embodiment fills borehole 10 around anodes 26 such that the backfill mixture contacts the earthen sidewall 12 and the exterior surfaces of anodes 26. According to certain aspects of the invention, the backfill mixture has a clay to carbonaceous solid weight ratio of at least about 0.1:1. Such a minimum weight ratio is desirable to ensure that the clay is present in the mixture in a sufficient amount to substantially reduce the permeability of the mixture to water. It is further preferably that the backfill mixture have a weight ratio of less than about 1:1 to ensure that it is not so impermeable to fluids as to be impermeable to gases produced along anodes 26 as discussed above. Such gases need to flow through the backfill mixture and into vent pipe 30 so as to prevent formation of gas filled gaps between anodes 26 and the backfill mixture. In the case of a water swellable clay, discussed further below, as a component of the backfill mixture, it is most preferably that the clay to carbonaceous solid weight ratio is in the range of about 0.2:1 to about 0.5:1.

Carbonaceous solid materials for use in the present invention include any carbon-containing materials. Examples include coke, ground bituminous or anthracite coal, graphite, and carbon black. It is preferred that the carbonaceous solid has a carbon content of at least about 70 percent by volume and particle sizes in the range of about 3 mesh to about 10 mesh. By way of example, particles having a size of 3 mesh indicates that they will pas through a 3 mesh screen. Either metallurgical or petroleum coke is preferred as the carbonaceous solid material. Metallurgical coke is a slag product left over from certain refinery processes. Petroleum coke results from incineration of certain petroleum products at high temperatures.

As used herein and in the appended claims, the term "clay" denotes a particulate substance which includes as its major (at least about 50 weight percent) component a clay mineral component which consists of one or more hydrous silicates. Clays are typically characterized by very small particles, typically in the range of about 40 mesh to smaller than about 200 mesh.

Although any type of clay is within the scope of certain aspects of the invention, it is preferred that the clay employed is a water swellable clay. A "water swellable clay" as used herein and in the appended claims is a clay whose particles swell in volume when wetted with water. Such water swellable clays include, for example, clays which contain at least one clay mineral from the smectite and vermiculite groups of clay minerals. A particularly preferred water swellable clay in accordance with the invention is sodium bentonite, which as used herein and in the appended claims is defined to include the smectite clay mineral sodium montmorillonite. Commercially available and particularly preferred sodium bentonites include SG-40, Saline Seal 100, PLS-50, SLS-70, and SLS-71, all of which are available from American Colloid Company of Skokie, Ill. Each of these commercially available sodium bentonites are also preferred since they are treated to resist attack by various contaminants such as salts.

Due to the small particle sizes associated with clays, the clay particles in the backfill mixture tend to fill voids between the larger carbonaceous solid particles. This desirably reduces the permeability of the mixture. The voids between carbonaceous solid particles are even better filled if a water swellable clay is used. As discussed previously, reduced permeability of the backfill mixture inhibits or prevents flow from one aquifer, such as aquifer 16, through the backfill mixture to another aquifer, such as aquifer 20. Therefore, intermingling and possible contamination of aquifers is effectively prevented.

With respect to the resistivity of the backfill mixture, such resistivity will typically be in the range of about 1 to about 30 ohm-centimeter, depending upon the types of carbonaceous solid and clay employed and the proportions in the mixture.

A seal 34 is preferably provided at the top of borehole 10. Such a seal can be made from, for example, a concrete grout or bentonite grout.

The cathodic protection system further includes a junction or terminal box 35 through which each of cable leads 28 is connected to the positive terminal of a DC electrical source 36. DC source 36 can be any suitable device for supplying a DC voltage. Most typically, DC source 36 comprises a transformer for reducing an AC voltage down to a predetermined level, and a rectifier of, for example, silicon or selenium which converts the voltage to DC. As shown, DC source 36 has its negative terminal connected by means of lead wire 38 to pipe 24. Therefore, anodes 26 are at a positive polarity whereas pipe 24 is at a negative polarity so as to act as a cathode.

Figure 2:
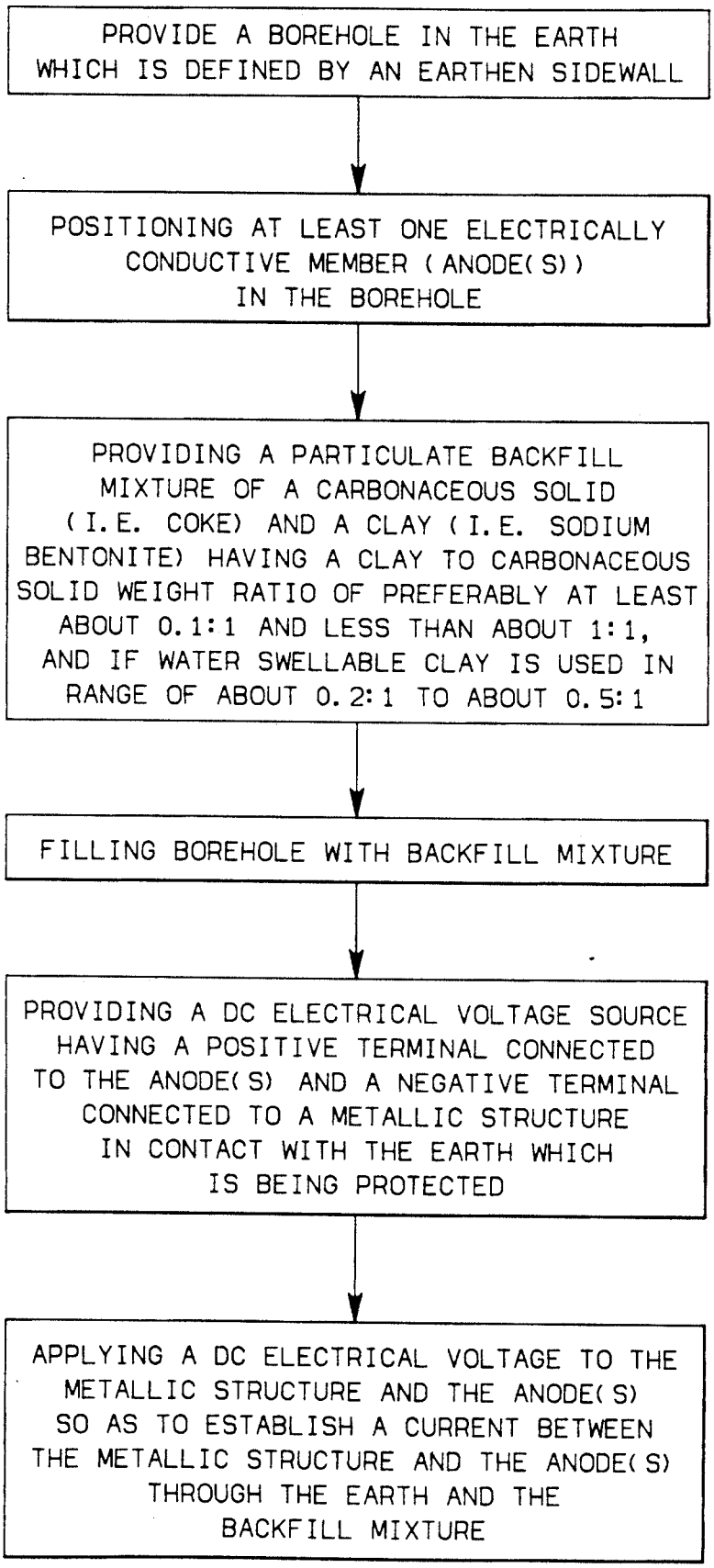
FIG. 2 is a flow chart which illustrates the various steps involved in preparing and using such a cathodic protection system.

Preparation and use of a cathodic protection system as shown in FIG. 1 involves the various steps described below and as set forth in the flow chart of FIG. 2.

Anodes 26 and vent pipe 30 are first lowered into borehole 10 so as to assume the positions shown in FIG. 1.

The backfill mixture is prepared above-ground by thoroughly mixing the clay and carbonaceous solid in the desired proportions. The backfill mixture is then preferably introduced into borehole 10 in the form of a slurry which is of a consistency so that is can be pumped into borehole 10. Such a slurry can contain, for example, about 10 to about 40 wt. % water of other appropriate liquid carrier and about 60 to about 90 wt. % backfill mixture. The slurry is most conveniently introduced into borehol 10 by lowering an injection pipe to the bottom of borehole 10, and then releasing the slurry from the injection pipe as it is pulled upwardly through borehole 10. It should be understood, however, that the backfill mixture could alternatively be prepared simply by mixing the clay and carbonaceous solid, and then shoveling the mixture into borehole 10.

After filling up borehole 10 with the backfill mixture, the top of borehole 10 is sealed with the grout seal 34.

The positive and negative terminals of DC source 36 are then connected, as discussed previously, to anodes 26 and pipe 24, respectively.

Cathodic protection is provided to pipe 24 by applying a DC electrical voltage to pipe 24 and anodes 26 so as to establish a current between pipe 24 and anodes 26 through the earth and the backfill mixture. Typical voltages employed are in the range of about 10 volts to about 80 volts. With respect to current, this parameter depends to a large degree on the surface area of the metallic structure being protected. It is generally desirable to apply a current of about 2 milliamps per square foot of surface area to be protected. Typically, a current in the range of about 5 amps to about 60 amps is employed.

An example will now be described to further illustrate the properties of a backfill mixture in accordance with the invention. It will be demonstrated that such properties are particularly advantageous in the environment of a cathodic protection system. This example is for the purpose of illustration only and should not be construed to limit the invention in any manner.

The following procedure pertains to the determination of the permeability of a backfill mixture in accordance with the invention.

A 600 g sample of coke was mixed with 150 g of Saline Seal 100 bentonite (available from American Colloid Company) to produce a backfill mixture having a bentonite to coke weight ratio of 0.25:1. 164.6 ml tap water (18 wt % of dry weight of coke and bentonite) was also added to resemble borehole conditions (i.e. backfill mixture injected in form of a slurry).

This backfill mixture was compacted by placing it in a 4 inch diameter "mold", or container, so as to fill the mold to a height of 6 inches, and then impacting the top of the mixture with a 5.5 pound hammer dropped from a height of 12 inches above the mixture 25 times in succession. This compacting procedure is in accordance with the compacting procedure used in conjunction with Standard Proctor ASTM procedure no. 698, Method A. A "head" of water 5 foot in height was then provided upon the compacted backfill mixture by means of a graduated (in ml) tube in fluid communication with the top of the mold. The head of water was monitored periodically to determine how many total (cumulative) milliliters of water had soaked into the compacted backfill mixture so as to be lost from head of water (decrease in volume of head). The rate at which the water soaked into the compacted backfill mixture, a measure of permeability, was then determined in units of cm/sec. The results are set forth in Table I.

TABLE I

| Time (Days) | Cumulative Head Volume Decrease (ml) | Permeability (cm/sec) |
|---|---|---|
| 1 | 96 | $8.5 \times 10^{-7}$ |

TABLE I-continued

| Time (Days) | Cumulative Head Volume Decrease (ml) | Permeability (cm/sec) |
|---|---|---|
| 2 | 187 | $7.1 \times 10^{-7}$ |
| 3 | 300 | $9.0 \times 10^{-7}$ |
| 4 | 437 | $1.1 \times 10^{-6}$ |
| 7 | >687 | $>7.1 \times 10^{-7}$ |
| 8 | >885 | $1.6 \times 10^{-6}$ |
| 9 | >1072 | $1.5 \times 10^{-6}$ |
| 10 | >1322 | $>2.1 \times 10^{-6}$ |

The above data shows that 10 days after the head of water was placed on the compacted backfill mixture, the water had soaked into the compacted mixture at a rate of slightly greater than $2.1 \times 10^{-6}$ cm/sec.

For carrying out another permeability test, a 600 g sample of coke was mixed with 200 g Saline Seal 100 bentonite, along with 176 ml tap water (18 wt. % of dry weight of coke and bentonite), to produce a backfill mixture having a clay to carbonaceous solid weight ratio of 0.33:1. The mixture was was compacted using the same procedure described above. A permeability test was carried out using a 5 ft. head of water, also as described above. The results are set forth in Table II.

TABLE II

| Time (Days) | Cumulative Head Volume Decrease (ml) | Permeability (cm/sec) |
|---|---|---|
| 1 | 33 | $2.2 \times 10^{-7}$ |
| 2 | 54 | $1.7 \times 10^{-7}$ |
| 5 | 102 | $1.3 \times 10^{-7}$ |
| 6 | 123 | $1.7 \times 10^{-7}$ |
| 7 | 145 | $1.7 \times 10^{-7}$ |
| 8 | 168 | $1.8 \times 10^{-7}$ |

The data shows excellent low permeability results with permeabilities in the range of $1.3 \times 10^{-7}$ to $2.2 \times 10^{-7}$ cm/sec. permeability measurements indicate that the compacted backfill mixture is for all practical purposes substantially impermeable to water.

Therefore, the data of Tables I and II collectively shows that a backfill mixture which is compacted to conditions approximating those expected in a borehole is highly impermeable to water and thus useful in preventing intermingling of aquifers.

A procedure was also carried out to determine the resistivity of a mixture of coke and Saline Seal 100 bentonite having a bentonite to coke weight ratio of about 0.33:1. The resistivity of such a mixture was measured in a dry state (natural atmospheric moisture content), and also in a saturated state (total added water of about 26 wt. % dry weight of mixture) wherein the mixture was saturated with deionized water. For the purpose of comparison, a sample of dry and saturated coke was tested for resistivity. Resistivities, set forth below in Table III, were determined in a Miller Soil box with each tested sample compacted to 67.4 lbs./ft$^3$ (maximum standard procter density) using the compacting procedure described previously.

TABLE III

| Material | Moisture Condition | Resistivity (ohm-cm) |
|---|---|---|
| Coke-Bentonite Mixture | Dry | 1.0 |
| Coke-Bentonite Mixture | Saturated | 1.4 |
| Coke Only | Dry | 3.5 |
| Coke Only | Saturated | 22.0 |

The above data shows that the coke-bentionite mixture is highly conductive and thus useful as backfill material in cathodic protection. It can further be seen from Table III that the coke-bentonite mixture is in fact less resistive (more conductive) than coke alone.

Obviously, many modifications and variations of the present invention are possible in light of the above teachings. It is therefore to be understood that within the scope of the appended claims the invention may be practiced otherwise than as specifically described.

That which is claimed is:

1. A cathodic protection system for protecting a metallic structure in contact with the earth from corrosion comprising:

at least one electrically conductive member positioned in a borehole in the earth which is defined by an earthen sidewall:

a quantity of a particulate mixture of a clay and a carbonaceous solid which at least partially fills said borehole around said at least one conductive member such that said mixture contacts said earthen sidewall and said at least one conductive member, wherein said mixture has a clay to carbonaceous solid weight ratio of at least about 0.1:1;

means for applying a DC electrical voltage to said metallic structure and said at least one conductive member such that said metallic structure is at a negative polarity and said at least one conductive member is at a positive polarity, whereby a current is established between said metallic structure and said at least one conductive member through the earth and said mixture.

2. A cathodic protection system as recited in claim 1 wherein said weight ratio is less than about 1:1.

3. a cathodic protection system as recited in claim 2 wherein said clay comprises a water swellable clay.

4. A cathodic protection system as recited in claim 3 wherein said water swellable clay is sodium bentonite.

5. A cathodic protection system as recited in claim 4 wherein said weight ratio is in the range of about 0.2:1 to about 0.5:1.

6. A cathodic protection system as recited in claim 5 wherein said carbonaceous solid comprises coke.

7. A method of cathodically protecting a metallic structure in contact with the earth from corrosion comprising:

providing a borehole in the earth, as defined by an earthen sidewall, with at least one electrically conductive member therein, said borehole being at least partially filled around said at least one conductive member with a particulate mixture of a clay and a carbonaceous solid such that said mixture is in contact with said at least one conductive member and said earthen sidewall, and wherein said mixture has a clay to carbonaceous solid weight ratio of at least about 0.1:1;

applying a DC electrical voltage to said metallic structure and said conductive member such that said metallic structure is at a negative polarity and said at least one conductive member is at a positive polarity, whereby a current is established between said metallic structure and said conductive member through the earth and said mixture.

8. A method as recited in claim 7 wherein said weight ratio is less than about 1:1.

9. A method as recited in claim 8 wherein said clay comprises a water swellable clay.

10. A method as recited in claim 9 wherein said water swellable clay is sodium bentonite.

11. A method as recited in claim 10 wherein said weight ratio is in the range of about 0.2:1 to about 0.5:1.

12. A method as recited in claim 11 wherein said carbonaceous solid comprises coke.

13. A method of preparing a cathodic protection system for protecting a metallic structure in contact with the earth from corrosion comprising:

(a) providing a borehole in the earth which is defined by an earthen sidewall;

(b) positioning at least one electrically conductive member in the borehole;

(c) providing a particulate mixture of a carbonaceous solid and a clay;

(d) filling, after step (c), at least a portion of the borehole with said mixture around said at least one conductive member such that said mixture contacts said at least one conductive member and said earthen sidewall;

(e) providing a DC electrical voltage source having a positive terminal connected to said at least one conductive member and a negative terminal connected to said metallic structure.

14. A method as recited in claim 13 wherein said mixture has a clay to carbonaceous solid weight ratio of at least about 0.1:1.

15. A method as recited in claim 14 wherein said weight ratio is less than about 1:1.

16. A method as recited in claim 15 wherein said clay comprises a water swellable clay.

17. A method as recited in claim 16 wherein said water swellable clay is sodium bentonite.

18. A method as recited in claim 17 wherein said weight ratio is in the range of about 0.2:1 to about 0.5:1.

19. A method as recited in claim 18 wherein said carbonaceous solid comprises coke.

20. A method as recited in claim 19 wherein in step (d) the borehole is filled with said mixture in the form of a slurry.

* * * * *